United States Patent [19]

Potrzuski et al.

[11] 3,935,669

[45] Feb. 3, 1976

[54] ELECTRICAL SIGNAL MECHANISM ACTUATED IN RESPONSE TO ROTATION ABOUT ANY OF THREE AXES

[76] Inventors: Stanley G. Potrzuski, 452 Elrino St.; Walter John Potrzuski, 9 N. Montford Ave., both of Baltimore, Md. 21224

[22] Filed: June 3, 1974

[21] Appl. No.: 476,038

[52] U.S. Cl. ..... 46/228; 46/47; 46/232; 200/61.45 R; 200/80 A; 200/187; 240/6.42; 240/10.6 R; 273/58 G; 273/63 R; 273/185 R; 273/213; 340/252 R

[51] Int. Cl.[2] ..... A63H 33/26

[58] Field of Search ..... 46/226, 227, 228, 229; 273/58 G, 213, 185 R, 183 C, 63 R; 200/184, 61.45 R, 187, 189, 80 A; 84/477 B; 240/6.42

[56] References Cited

UNITED STATES PATENTS

| | | | |
|---|---|---|---|
| 2,164,991 | 7/1939 | Ingres | 200/80 A |
| 2,583,273 | 1/1952 | Miller | 200/187 X |
| 2,903,820 | 9/1959 | Bodell | 46/228 |
| 3,325,940 | 6/1967 | Davis | 46/228 |
| 3,384,741 | 5/1968 | Bice | 240/6.42 |
| 3,720,426 | 3/1973 | Johnston | 200/61.45 R |
| 3,798,834 | 3/1974 | Samuel | 46/228 |

FOREIGN PATENTS OR APPLICATIONS

| | | | |
|---|---|---|---|
| 33,434 | 11/1964 | Germany | 46/228 |

*Primary Examiner*—F. Barry Shay
*Attorney, Agent, or Firm*—Oblon, Fisher, Spivak, McClelland & Maier

[57] ABSTRACT

An object (baton, ball, etc,) which generates a signal (visual audio, etc.) only when in rotation and when in rotation generates a continuous signal. A power source, a first switch which assumes its ON position in response to centrifugal force, a second switch which assumes its ON position in response to centrifugal force, and means for generating a signal, connected in series are carried in the object. The first and second switches are mounted so that both are ON when the object is in rotation about a first axis, but not when it is at rest. Third and fourth switches may be placed to be ON when the object is in rotation about second and third axes at right angles to said first axis and to each other. The switches may be closed by movement of a fluid or of sliding or rolling elements.

8 Claims, 13 Drawing Figures

ELECTRICAL SIGNAL MECHANISM ACTUATED IN RESPONSE TO ROTATION ABOUT ANY OF THREE AXES

BACKGROUND OF THE INVENTION

1. Field of the Invention:

The present invention relates to a centrifugally actuated signal generating object. More particularly, the present invention relates to an object such as a toy which generates a signal only when in rotation and when in rotation generates a continuous signal. Such an object could be a tossing disc, a spinning top, a football, a spherical ball, a baton, a hula hoop, a bicycle wheel, etc.

2. Description of the Prior Art:

The prior art includes a yo-yo which includes a small battery which powers a small bulb to illuminate the yo-yo. The circuit containing the small bulb and the small battery includes a contact and a resilient metal strip. The centrifugal force resulting from the rotation of the yo-yo causes the resilient metal strip to abut the contact causing closing of the circuit.

However, applicants have found that such circuitry is generally unreliable because of the difficulty in adjusting the resilient metal strip so that the circuit is closed during rotation and remains open during periods of nonrotation. In addition, this circuitry does not appear to be adaptable for use with other toys, such as a tossing disc, a spinning top, a football, a spherical ball, a baton, a hula hoop, a bicycle wheel, etc. where it is desired that the object be illuminated in a continuous manner during rotation and it is further desired that there be no illumination and no drain on the battery during periods of nonrotation.

SUMMARY OF THE INVENTION

Accordingly, it is an object of the present invention to provide an object which generates a signal only when in rotation and when in rotation generates a continuous signal.

It is a further object of the present invention to illuminate a tossing disc, a spinning top, a football, a spherical ball, a baton, a hula hoop, a bicycle wheel, etc. while in rotation but to prevent drain on the power source during periods of nonrotation.

It is yet a further object of the present invention to provide circuitry for achieving this end wherein the centrifugal actuated switches are mercury switches, rolling ball switches, sliding object switches, etc.

A further object of the present invention is to provide the object with a centrifugally actuated visual signal.

It is a further object of the present invention to provide the object with a centrifugally actuated audio signal.

It is a further object of the present invention to provide an explosive firework wherein a detonation signal is generated after a predetermined rotational speed is attained.

It is a further object of the present invention to dispose the object so that it may be rotated by wind.

It is a further object of the present invention to dispose the object so that it may be rotated by movement in water.

It is a further object of the present invention to dispose the object so that it may be manually rotated.

It is a further object of the present invention to provide the object with first and second signal generating means so that, for example, illumination and sound may be simultaneously provided.

It is a further object of the present invention to provide centrifugally actuated signal generating means for an object having two pairs of switches whereby the first pair may be actuated upon rotation about the X-axis, the second pair may be actuated upon rotation about the Y-axis, and both pairs may be actuated upon rotation about the Z-axis.

It is a further object of the present invention to provide an object which generates a signal only when in rotation irrespective of the rest position of the object.

Other objectives will appear hereinafter.

These and other objectives are achieved by an object which generates a signal only when in rotation and when in rotation generates a continuous signal comprising a support structure, circuitry mounted to said support structure comprising a power source, a first switch which assumes its on position in response to centrifugal force, a second switch which assumes its on position in response to centrifugal force, means for generating a signal, means connecting said power source, said first switch, said second switch and said means for generating a signal in series, said first switch being mounted to said support structure so that it is in its on position when said support structure is in rotation, said second switch being mounted to said support structure so that it is in its on position when said support structure is in rotation and so that it is in its off position when said support structure is not in rotation and when said first switch is in its on position due to gravity rather than to rotation, whereby said means for generating a signal is actuated only when said support structure is in rotation and whereby when said support structure is in rotation said means for generating a signal is actuated continuously.

BRIEF DESCRIPTION OF THE DRAWINGS

Various other objectives, features and attendant advantages of this invention will be more fully appreciated as the same becomes better understood by reference to the following detailed description when considered in connection with the accompanying drawings, wherein.

DESCRIPTION OF THE PREFERRED EMBODIMENTS

Figure 1:
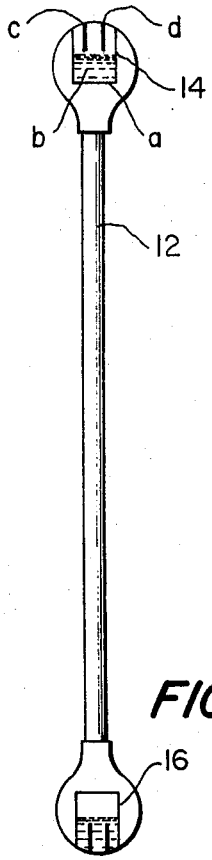
FIG. 1 is a view of the one circuit embodiment of the present invention in its rest position.

The following is an explanation of the present invention with respect to the preferred embodiments illustrated in the drawings wherein like numerals designate like elements.

As indicated above, one of the objects of the present invention is to provide an object such as a toy with circuitry which will provide continuous illumination during rotation but which will provide no illumination and therefore no drain on the power source during periods of nonrotation. As also mentioned above, it is desirable that no illumination be provided and therefore no drain on the power source regardless of the resting position of the object to be illuminated.

FIG. 1 shows a baton provided with circuitry of the instant invention so that it will be illuminated when rotated but will not be illuminated and will not drain the power source when not in rotation regardless of its rest position. As shown in FIG. 1, baton 12 is equipped with mercury switches 14 and 16. Mercury switch 14 is comprised of container a, electrically conductive mercury b and contacts c and d. As shown in FIG. 1, the mercury in switch 14 is drawn to the bottom of container a by gravity with the result that contacts c and d are not bridged by the mercury causing an electrical open circuit. Mercury switch 16, on the other hand, has the mercury drawn to the bottom of the container by force of gravity with the result that the contacts are bridged by the electrically conductive mercury. However, as will be seen with reference to FIGS. 3 and 4, both switches 14 and 16 have to be actuated before illumination is provided.

Figure 2:
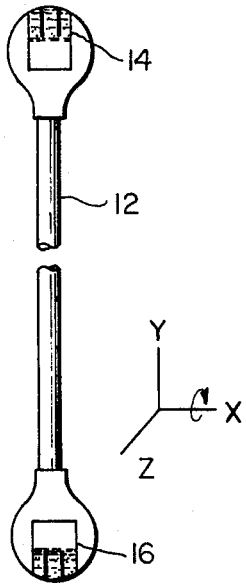
FIG. 2 is a view of the one circuit embodiment of the present invention in rotation.

FIG. 2 shows baton 12 in rotation about the X-axis causing the mercury and mercury switches 14 and 16 to bridge the contacts in each switch. This is because the centrifugal force generated by the rotation causes the mercury in switch 14 to bridge the contacts of the mercury switch. As mentioned above, when both mercury switches 14 and 16 are in their on position, illumination is provided to baton 12.

Figure 3:
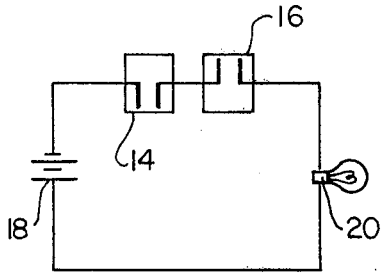
FIG. 3 is a circuit diagram of the one circuit embodiment of the present invention showing the use of one light bulb.

FIG. 3 is a circuit diagram of circuitry utilized with baton 12 as shown in FIG. 2. As shown in FIG. 3, the circuit consists of power source 18 which may be a small d.c. battery connected in series with switches 14 and 16 and illumination means such as light bulb 20. Because of the series arrangement, light bulb 20 will not be illuminated when only one of the switches 14 and 16 is in its on position such as its rest position shown in FIG. 1. Only when both switches are in their on positions such as shown in FIG. 2 will light bulb 20 be illuminated.

Figure 4:
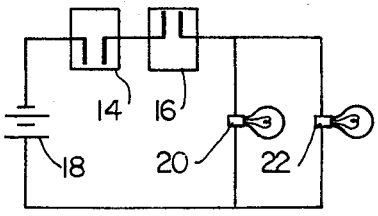
FIG. 4 is a circuit diagram of the one circuit embodiment of the present invention showing the use of a plurality of light bulbs.

FIG. 4 shows a modification of the circuitry of FIG. 3 wherein a light bulb 22 is disposed in parallel with light bulb 20 to permit the use of a plurality of illumination means.

It should be noted at this point that the present invention includes not only the use of illumination means actuated by centrifugal force but also other means such as audio generating means, means to impart subsequential motion, etc.

The one circuit embodiment shown in FIGS. 1 and 2 is quite suitable where rotation is expected about only two of the possible three axes. For example, in FIGS. 1 and 2, switches 14 and 16 will assume their on positions if there is rotation about the X-axis or the Z-axis. Rotation about the Y-axis will not cause switch 14 to be disposed in its on position with the result that baton 12 will not be illuminated. However, use of baton 12 is not expected to result in rotation about the Y-axis with the result that this contingency need not be provided for.

Other objects which have expected rotation about no more than two of the three axes for which the one circuit embodiment of the present invention is suitable are a tossing disc, a spinning top, a hula hoop and a bicycle wheel. Clearly, the scope of the present invention includes other such objects wherein expected rotation is about one or two but not three axes.

The two circuit embodiment of the present invention is suitable for objects wherein rotation may be about any one of the three axes. Such an object may be a spherical ball, another such object may be a football which can be "spiralled" about its longitudinal axis or which may be rotated end over end about either of the other two axes.

Figure 5:
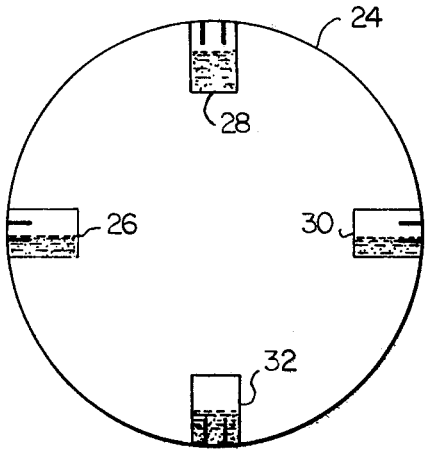
FIG. 5 is a view of the two circuit embodiment of the present invention in its rest position.

FIG. 5 shows a spherical ball 24 equipped with the circuitry of the present invention. Mercury switches 26, 28, 30 and 32 are provided. Illumination will be provided for ball 24 whenever switches 26 and 30 are in their on positions or whenever switches 28 and 32 are in their on positions. FIG. 5 shows ball 24 in its rest position wherein only switch 32 is in its on position due to the force of gravity. Since the force of gravity causes switch 28 to be in its off position, as well as switches 26 and 30 to be in their off positions, no illumination and therefore no drain on the power source occurs when ball 24 is in its rest position.

Figure 6:
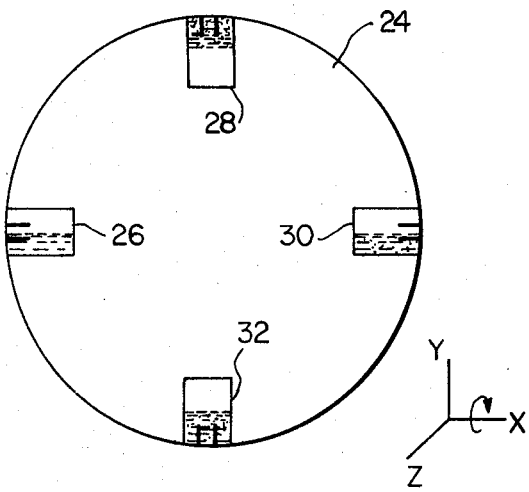
FIG. 6 is a view of the two circuit embodiment of the present invention in rotation about the X-axis.

FIG. 6 shows ball 24 when in rotation about the X-axis. Centrifugal force caused by rotation about the X-axis causes switches 28 and 32 to assume their on positions causing illumination of ball 24.

Figure 7:
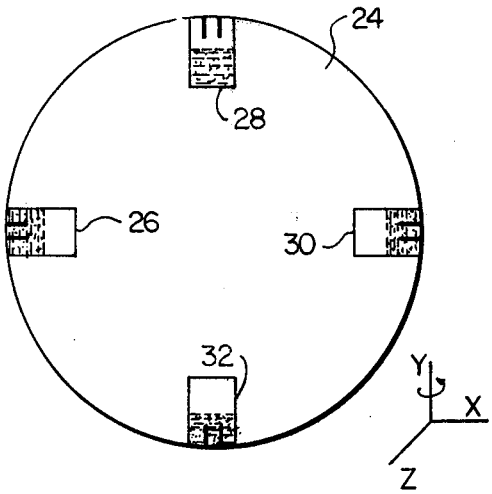
FIG. 7 is a view of the two circuit embodiment of the present invention in rotation about the Y-axis.

FIG. 7 shows ball 24 when in rotation about Y-axis. Rotation about the Y-axis causes switches 26 and 30 to assume their on positions causing illumination of the ball 24.

Figure 8:
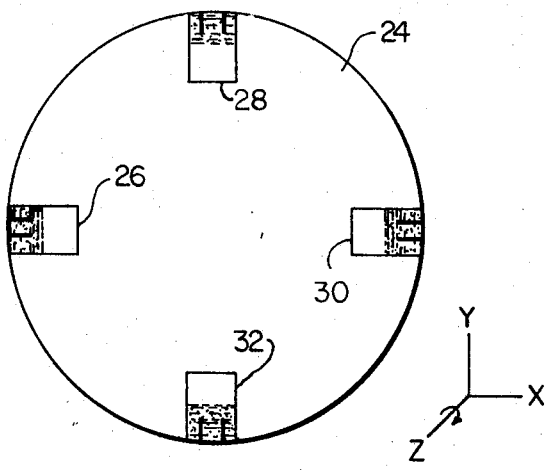
FIG. 8 is a view of the two circuit embodiment of the present invention in rotation about the Z-axis.

FIG. 8 shows ball 24 when in rotation about the Z-axis. Centrifugal force caused by rotation about the Z-axis causes switches 26 and 30 as well as switches 28 and 32 to assume their on positions resulting in illumination of ball 24.

Figure 9:
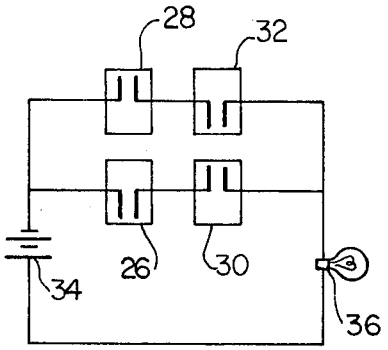
FIG. 9 is a circuit diagram of the two circuit embodiment of the present invention.

FIG. 9 illustrates the circuitry of the two circuit embodiment of the present invention. As shown in FIG. 9, the circuit includes power source 34 which may be a small d.c. battery which is connected to light bulb 36 through two parallel paths consisting of switches 26 and 30 and switches 28 and 32. As is evident from the circuitry, switches 26 and 30 or switches 28 and 32 must be in their on positions in order to provide illumination of light bulb 36.

As noted above, the scope of the present invention is not restricted to illumination means but covers the generation of any signal. Another signal which could be utilized would be an audio signal or a motion signal. It is also within the scope of the present invention to provide for the generation of more than one signal. For example, both sound and light could be generated at the same time.

Although the one circuit and two circuit embodiments of the present invention described above have been illustrated in conjunction with mercury switches, it is clear that other switches responsive to centrifugal force may be utilized.

Figure 10:
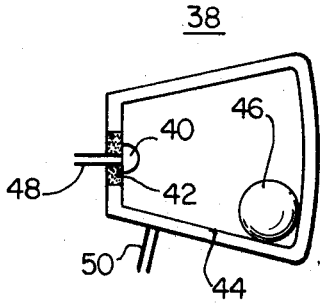
FIG. 10 is a view of a rolling ball switch in its rest position.

FIG. 10 shows a rolling ball switch which may be used in either the one circuit embodiment or two circuit embodiment of the present invention. As shown in FIG. 10, rolling ball switch 38 consists of electrically conductive contacts 40 and 44 which are respectively connected to electrical lead wires 48 and 50. Contact 40 is insulated from electrically conductive material 44 by nonconductive material 42. FIG. 10 shows switch 38 in its rest position wherein conductive ball 46 does not bridge the gap between contacts 40 and 44 causing an open electrical circuit.

Figure 11:
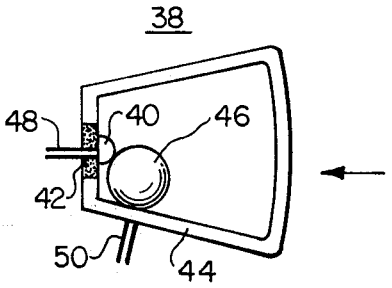
FIG. 11 is a view of a rolling ball switch in its dynamic position.

FIG. 11 shows rolling ball switch 38 in its dynamic position when under the influence of centrifugal force shown in the direction of the arrow. This causes conductive ball 46 to abut contact 40 and thereby bridge the gap between contacts 40 and 44 permitting electrical current to flow between electrical lead wires 48 and 50.

Figure 12:
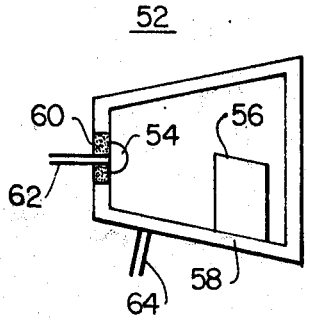
FIG. 12 is a view of a sliding member switch in its rest position.

FIG. 12 shows sliding member switch 52 which may also be utilized in either the one circuit or two circuit embodiments of the present invention. As shown in FIG. 12, sliding member switch 52 consists of electrical contact 54 and electrically conductive material 58 to which electrical lead wires 62 and 64 are respectively attached. Contact 54 is insulated from electrically conductive material 58 by nonconductive material 60. FIG. 12 shows sliding member switch 52 at its rest position wherein sliding member 56 does not bridge the gap between contact 54 and electrically conductive material 58 causing an open electrical circuit between electrical lead wires 62 and 64.

Figure 13:
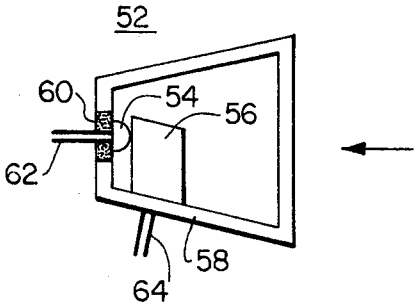
FIG. 13 is a view of a sliding member switch in its dynamic position.

FIG. 13 shows sliding member switch 52 in its dynamic position caused by centrifugal force in the direction indicated by the arrow. The centrifugal force causes conductive member 56 to abut contact 54 and to contact conductive material 58 to bridge the gap between contact 54 and electrically conductive material 58 causing a closed circuit between electrical lead wires 62 and 64.

Although the present invention has been described with reference to the illumination of toys during rotation, other applications are also contemplated and are believed to be within the scope of the present invention. For example, the problems encountered with the detonation of fireworks and other hurled explosives may be overcome by utilizing the circuitry of the present invention which could cause detonation of a firework only after it had attained a certain rotational velocity and duration thereafter which would mean that it would be a certain safe distance from the person throwing the firework or explosive.

The circuitry of the present invention also could be utilized to provide a warning if certain conditions were exceeded. Thus, circuitry of the present invention could be utilized in conjunction with a weather vane to indicate when wind velocity exceeded a certain predetermined limit. The switches used in the present invention could be of such a design that they would be actuated only upon attainment of a certain rotational velocity which would correspond to this predetermined wind speed limit.

The circuitry of the present invention can also be utilized to illuminate a boat when in motion by using a water wheel type arrangement which causes rotation only when the boat is moved through the water.

Although applicant has not specifically set forth the manner of mounting the switches of the circuitry of the present invention to the object to be rotated. it is clear that various mountings may be utilized. For example, with reference to the baton shown in FIG. 1, the switches could be connected by a bar which would maintain the fixed relationship between switches 14 and 16 or, alternatively, switches 14 and 16 could be separately mounted at ends of the baton. Similarly, with respect to the ball shown in FIG. 4, a bar can connect switches 28 and 32 and another bar can connect switches 26 and 30 and the two bars may be joined at their center in order to maintain their switches in their respective positions. Alternatively, switches 26, 28, 30 and 32 may be othewise attached to sphere 24 by adhesives, rivets, et.

Having now fully described the invention, it will be apparent to one of ordinary skill in the art that many changes and modifications can be made thereto without departing from the spirit and scope of the appended claims.

What is claimed as new and desired to be secured by Letter Patent of the United States is:

1. An object which generates a signal only when in rotation and when in rotation generates a continuous signal comprising:

a support structure, circuitry mounted to said support structure comprising a power source, switch means including a first switch which can assume its ON position in response to centrifugal force, said switch means further including a second switch which assumes its ON position in response to centrifugal force, means for generating a signal, means connecting electrically in series said power source, said first switch, said second switch and said means for generating a signal, said first switch being mounted to said support structure in a position such that it is in its ON position as a result of centrifugal force generated when said support structure is in rotation about a given axis, said second switch being mounted to said support structure in a position such that it is in its ON position as a result of centrifugal force generated when said support structure is in rotation about said axis and so that it is in its OFF position when said support structure is not in rotation and when said first switch is in its ON position due to gravity rather than to rotation, whereby said means for generating a signal is actuated only when said support structure is in rotation and whereby when said support structure is in rotation said means for generating a signal is actuated continuously, said switch means further including a third switch and a fourth switch which can assume their ON positions in response to centrifugal rotation, means connecting said third and fourth switches in series with a power source and a signal generating means, said switches being mounted in positions in said support structure whereby rotation of said object about its X-axis causes said first and second switches to assume their ON positions, rotation of said object about its Y-axis causes said third and fourth switches to assume their ON positions and rotation of said object about its Z-axis causes said first, second, third and fourth switches to assume their ON positions.

2. An object in accordance with claim 1 wherein said first and second switches are mercury switches.

3. An object in accordance with claim 1 wherein said first and second switches are rolling ball switches.

4. An object in accordance with claim 1 wherein said first and second switches are sliding member switches.

5. An object in accordance with claim 1 wherein said means for generating a signal generates a visual signal.

6. An object in accordance with claim 1 wherein said means for generating a signal generates an audio signal.

7. An object in accordance with claim 1 wherein said object is a football.

8. An object in accordance with claim 1 wherein said object is a spherical ball.

* * * * *